US008214964B1

(12) United States Patent
Coleman

(10) Patent No.: US 8,214,964 B1
(45) Date of Patent: Jul. 10, 2012

(54) CLEANING TOOL FOR REMOVING UNDESIRABLE MARINE GROWTH FROM A SUPPORT SURFACE AND ASSOCIATED METHOD

(76) Inventor: Randy B. Coleman, St. Pete Beach, FL (US)

( * ) Notice: Subject to any disclaimer, the term of this patent is extended or adjusted under 35 U.S.C. 154(b) by 547 days.

(21) Appl. No.: 12/319,581

(22) Filed: Jan. 9, 2009

Related U.S. Application Data

(60) Provisional application No. 61/010,699, filed on Jan. 11, 2008.

(51) Int. Cl.
*A47L 13/08* (2006.01)
*B63B 59/06* (2006.01)
*B63B 59/08* (2006.01)

(52) U.S. Cl. ..... 15/236.05; 15/236.01; 15/236.06; 15/236.07; 30/169; 30/172; 114/221 R; 114/222

(58) Field of Classification Search ..... 15/104.04, 15/235.4–235.8, 236.01, 236.05–236.09, 15/245.1; 30/169, 172; 114/221 R, 222; D32/46–49
See application file for complete search history.

(56) References Cited

U.S. PATENT DOCUMENTS

| | | | | | |
|---|---|---|---|---|---|
| 2,333,878 | A | * | 11/1943 | Nelson | 30/136 |
| 2,720,858 | A | | 10/1955 | Siefken | |
| 2,944,275 | A | * | 7/1960 | Markusen | 15/236.01 |
| 2,946,076 | A | * | 7/1960 | Morgan | 15/236.02 |
| 3,274,684 | A | * | 9/1966 | Marks | 30/171 |
| 4,649,849 | A | * | 3/1987 | McCormick | 114/222 |
| 4,781,139 | A | | 11/1988 | Burgers | |
| 4,909,173 | A | | 3/1990 | Strong | |
| 5,209,176 | A | | 5/1993 | Pompei et al. | |
| 5,809,604 | A | * | 9/1998 | Olstyn | 15/111 |
| 5,951,781 | A | | 9/1999 | Lucas | |
| 6,732,671 | B2 | | 5/2004 | Johnson | |

* cited by examiner

*Primary Examiner* — Mark Spisich

(57) ABSTRACT

A scraping tool includes a first scraping head, a bracket affixed to the first scraping head, and an elongated pole removably coupled to the bracket access hard-to-reach target zones. In one embodiment, the bracket and the pole are freely articulated along a 360 degree circular path defined adjacent to the outer surface. In another embodiment, the bracket is statically affixed to the first scraping head and a connector is removably engaged with the bracket to quickly reconnect a variety of scraping heads. A rigid fastening member traverses through the connector as well as the second bore respectively. In another embodiment, a second scraping head is affixed to the connector for enabling the user to quickly toggle between the first and second scraping heads.

12 Claims, 11 Drawing Sheets

CLEANING TOOL FOR REMOVING UNDESIRABLE MARINE GROWTH FROM A SUPPORT SURFACE AND ASSOCIATED METHOD

CROSS REFERENCE TO RELATED APPLICATIONS

This application claims the benefit of U.S. Provisional Application No. 61/010,699, filed Jan. 11, 2008, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to hand-held cleaning tools and, more particularly, to hand-held cleaning tool for effectively scraping marine growth from hard-to-reach surfaces without using chemicals or toxic agents.

2. Prior Art

Marine growth is a constant maintenance issue for anyone that owns a pool, dock, boat, or other aquatic vessel or vehicle. The problem of removing marine growth from the surfaces of boat hulls has been a problem that has existed for as long as boats have been plying large bodies of salt water. It does not appear to be a problem where boats are utilized in bodies of fresh water. The problem however is not restricted only to boat hulls in salt water.

Rather, the problem includes the accumulation of sediment and scum on the walls of swimming pools and other underwater surfaces. With regard to marine growth on the hulls of recreational boats, such growth can seriously affect the efficiency of the boat hull in the water, and must therefore be removed periodically to use the boat to best advantage. There are various types of marine growth, one form being a type of scum or slime that seems to attach itself to wide expanses of underwater hull surfaces, while other types of marine growth include barnacle-like creatures that attach themselves to the hull and form a protrusion from the outer surface of the boat hull that has a very detrimental effect on the speed that may be achieved by the boat in the water.

It is therefore an object of the present invention to provide a scrubbing device that is effective to remove all types of marine growth that might attach itself to the underwater surface of a boat hull. Because of the different types of marine growth that attach themselves to a boat hull, it is necessary that a scrubbing device possess the versatility to remove all types of marine growth.

Accordingly, another object of the invention is the provision of a scrubbing device that may be quickly and easily converted from a scrubbing device for removing a uniform layer of marine growth to one for removing marine growth such as barnacles. The most expedient way of cleaning the underside of a boat hull is to haul the boat out of the water so that access can be had to all of the under surfaces of the boat apart from the water in which they are usually submerged. However, hauling a boat out of the water can be an expensive procedure and is to be avoided if possible.

Accordingly, still another object of the invention is the provision of a scrubbing device for scrubbing boat hulls that is effective for scrubbing a submerged surface of the boat hull while the person manipulating the scrubbing device is standing or kneeling on a wharf or floatation platform along side the boat. With some types of pleasure boats, such as motor launches that are essentially flat bottomed boats, to scrub the underside or bottom of the boat while the boat is resting in the water it is necessary that a diver equipped with self contained underwater breathing apparatus (scuba) enter the water and physically scrape the bottom of the boat with an appropriate tool. Accordingly, another object of the present invention is the provision of a scrubbing device for the underside of boats that may be utilized by a diver equipped with scuba.

One of the problems that is frequently encountered with scrubbing devices for scrubbing the underside of boat hulls is the strength and stamina that must be possessed by the person operating the scrubbing device. Many such devices are makeshift and require manipulation by a strong man, accustomed to doing that type work. Accordingly, a still further object of the present invention is the provision of a scrubbing device that may be manipulated by even a small person unaccustomed to manipulating a scrubbing device of any kind.

When a boat hull is submerged and it is attempted to scrub the submerged surface, it is necessary that the scrubbing device be pressed forcefully against the fouled boat surface and manipulated, usually by reciprocation, to abrade the surface to remove the marine growth thereon. The problem lies in the manner and means of applying such force to the scrubbing device while the person manipulating the scrubbing device is standing or kneeling on the dock or wharf. One method of course is to utilize a long, stiff and rigid handle on one end of which is attached the abrading means.

Using the long, stiff and rigid handle as a lever, the operator can exert a certain amount of force on the boat hull with the abrading device and when the device is reciprocated, the marine growth will be removed. The difficulty with such a device is that most boat hulls are contoured to provide curved surfaces and the utilization of such a stiff and rigid device does not enable the cleaning of such contoured surfaces. Accordingly, another object of the present invention is the provision of a scrubbing device for contoured boat hulls in which the scrubbing device includes an elongated and resiliently flexible handle that enables the scrubbing device to follow the contoured boat hull.

It is desirable that it not be necessary for the operator by a conscious effort to force or press the abrading device against the boat hull during the scrubbing procedure. It is preferable that the operator exert merely a reciprocating motion to the scrubbing device, with the application force being applied substantially automatically. Accordingly, a still further object of the invention is the provision of a scrubbing device for scrubbing the underwater surfaces of a boat hull from a dock or wharf which when manipulated by axial reciprocating movement of the handle, causes the scrubbing device to be pressed snugly against the contoured boat hull to thus remove whatever marine growth has attached itself to the boat hull.

Accordingly, a need remains for an aquatic cleaning tool in order to overcome the above-noted shortcomings. The present invention satisfies such a need by providing an apparatus that is convenient and easy to use, durable, inexpensive, efficient, compact, adjustable, and effective.

BRIEF SUMMARY OF THE INVENTION

In view of the foregoing background, it is therefore an object of the present invention to provide an apparatus for removing existing marine growth from hard-to-reach target zones, such as dock pilings and boat hulls, for example. Exemplary marine growth may include barnacles, for example. These and other objects, features, and advantages of the invention are provided by a hand-held scraping tool that is abutted against the hard-to-reach surface.

The scraping tool is preferably held at a non-perpendicular angle against the hard-to-reach target zone so that the scraping tool can effectively remove the marine growth without bouncing off the barnacles, for example. An exemplary angle may be approximately 45 degrees, for example, but can vary according to location of the user and marine growth, as understood by one skilled in the art.

The present invention includes a scraping tool preferably including a first scraping head having a curvilinear shape and being provided with an apex medially offset between oppositely seated lateral edges of the first scraping head. The first scraping head may further have oppositely disposed top and bottom curvilinear edges for engaging and removing the marine growth from the hard-to-reach target zones. Such curvilinear edges preferably have rigid and suitably thin cross-sections for effectively severing the marine growth from the target zone. The first scraping head may further have a concave inner surface for conforming to an annular shape of a dock piling, for example.

The present invention further includes a bracket affixed to an outer surface of the first scraping head such that the bracket adjoins the apex and thereby remains proximately juxtaposed adjacent to the outer surface. Of course, it is understood the bracket is suitably connected to the first scraping head for allowing the user to easily maneuver the first scraping head after a pole (described hereinbelow) is attached to the bracket.

Notably, the top and bottom curvilinear edges are spaced above and below the bracket for assisting a user to effectively engage the hard-to-reach target zones without interference from the bracket. This permits the user to effectively separate the existing marine growth from the hard-to-reach target zones by upwardly and downwardly reciprocating the first scraping head against the hard-to-reach target zones respectively. The first scraping head and the bracket are preferably formed from non-corrosive material to resist rust and decay during extended use in harsh environments, such as salt water, for example.

The present invention may also an elongated pole removably coupled to the bracket and remaining spaced posterior to the first scraping head such that the user is able to freely engage the inner surface along the hard-to-reach target zones. By positioning the pole directly into the bracket, the inner surface as well as the top and bottom curvilinear edges is free to repeatedly engage and scrap the marine growth away from the hard-to-reach target zone while the user is safely positioned away from the first scraping head.

In one embodiment, the apex of the first scraping head preferably has a thickness that is greater than a thickness of the lateral edges respectively and thereby defines a center of mass at the apex for assisting the user to effectively maneuver the first scraping head along the hard-to-reach target zones. Such a feature is important because although the bracket and pole freely pivot with respect to the first scraping head, the user is able to maintain suitable control and accuracy when the center of mass is aligned with the longitudinal axis of the pole, for example.

In such an embodiment, the bracket preferably includes a stationary anchor statically affixed directly to the outer surface of the first scraping head. Such a stationary anchor has a socket formed therein, which faces away from the outer surface of the first scraping head. The bracket may further include a mobile anchor provided with a ball formed at a distal end thereof. The ball is rotatably seated within the socket such that the mobile anchor is freely articulated along a 360 degree circular path defined adjacent to the outer surface. This feature permits the user to freely bias the first scraping head at various angles during scraping procedures.

The mobile anchor may further have a threaded sleeve formed at a proximal end thereof. Such a sleeve preferably faces away from the first scraping head and is securely mated with the pole such that the first scraping head and the stationary anchor remain at a fixed position while the pole and the mobile anchor are contemporaneously articulated along the circular path.

In another embodiment, the present invention preferably includes a connector directly and statically connected to the outer surface of the first scraping head. Such a connector is preferably aligned with the apex of the first scraping head to support the first scraping head at its center of mass. In this manner, the user is able to accurately bias the first scraping head between various positions without having to overcompensate for any weight offset from the pole, for example.

The connector may orthogonally extend away from the apex and may further terminate at a predetermined distance therefrom such that the connector remains situated posterior of the inner surface during use of the first scraping head. It is noted that the thickness of the connector is preferably minimized to reduce the likelihood of weighing down the first scraping head during reciprocating motions. Also, it is important for the connector to terminate within an outer perimeter of the first scraping head to permit continuous contact between the top and bottom curvilinear edges during upward and downward movement along the marine growth, for example.

Further, the bracket in such an embodiment is preferably provided with orthogonally registered first and second bores formed therein. The first bore may be axially aligned along a partial longitudinal length of the bracket in such a manner that the connecter is spaced from the first bore. The first bore may also have a threaded inner surface and may be formed in a first half of the bracket such that the first bore axially extends from a first axial end of the bracket and terminates substantially midway to an opposing second axial end of the bracket. In this manner the connector is able to penetrate through the bracket without intersecting the first bore. This permits the first half of the bracket to maintain a fixed diameter for removably receiving the pole at said first bore.

The second bore is preferably formed at a second half of the bracket and may extend along a mutually exclusive path that is offset from the first bore, so that the pole remains spaced away from the second bore does not exert operating forces on the connector during reciprocating motions. The second bore preferably begins from approximately midway between the first and second axial ends of the bracket and terminates at the second axial end of the bracket such that an opening is formed at the second axial end for receiving the connector therethrough. In this manner, the user is able to freely selectively reconnect a variety of scraping heads to the bracket while the pole remains continuously affixed to the bracket, for example.

The connector may have a substantially rectangular shape and preferably passes through an entire width of the second bore such that opposed edges of the connector are situated exterior of the bracket. Thus, an empty buffer zone is formed between the bracket and the scraping heads to minimize any potential of undesirable forces acting against the outer surfaces of the scraping heads.

The present invention may further include a rigid fastening member traversing through the connector as well as the second bore respectively. The fastening member is preferably located at the second half of the bracket such that a diameter of the second half of the bracket is selectively reduced and expanded as the fastening member is tightened and loosened respectively. In particular, the second bore is in open communication with the second axial end of the bracket. This permits the second half of the bracket to be resiliently compressed and expanded as the fastening member is tightened and loosed. Such a fastening member may include a conventional threaded bolt, washers and associated nut for permitting the user to quickly and effectively connect the fastening member to the connector and bracket, as needed.

In this manner, the fastening member maintains the connector statically affixed to the second half of the bracket and thereby prohibits the first scraping head from becoming undesirably displaced away from the bracket during reciprocating motions. Because the first scraping head has a center of mass aligned with the connector, the weight of the fastening member is further aligned with the apex of the first scraping head to reduce any likelihood of premature shifting between the fastening member and bracket during extended scraping procedures.

The present invention may further include a second scraping head statically affixed directly to the connector such that the first and second scraping heads maintain a fixed spatial distance therebetween, respectively. Thus, the pole is prevented from knocking against the first and second scraping heads during quick and abrupt jerking motions by the user.

Notably, the bracket is intercalated between the first and second scraping heads and thereby permits the outer surfaces of the first and second scraping head to remain equidistantly offset from the pole such that the user can interchangeably employ the first and second scraping heads by rotating the pole 180 degrees. For example, the second scraping head may be situated anterior of the bracket while the first scraping head is situated posterior of the bracket for enabling the user to quickly toggle between the first and second scraping heads, as needed, during scraping procedures.

Further, the second scraping head may have a rectangular shape and may be provided with rectilinear inner and outer surfaces for engaging substantially planar target zones, such as boat hulls, for example. The second scraping head may further have rigid top and bottom edges for effectively removing the existing marine growth, similar to the first scraping head. The cross-section of the first and second scraping heads may be suitably sized depending on the intended application.

In one embodiment, the first and second bores may be respectively registered along first and second axes while the fastening member may be registered along a third axis. Thus, the first, second and third axes may be respectively registered orthogonally to each other such that the first, second and third axes lay along an x-axis, a y-axis and a z-axis respectively. In this manner, operating forces acting along any one axis, may counter-balance and equalize operating forces that are oppositely acting along another axis, for example.

The present invention may further include a method for using a scraping tool to remove existing marine growth from hard-to-reach target zones. Such a method preferably includes the chronological steps of: providing a first scraping head having a curvilinear shape and being provided with an apex medially offset between oppositely seated lateral edges of the first scraping head. The first scraping head further has oppositely disposed top and bottom curvilinear edges for engaging and removing the existing marine growth from the hard-to-reach target zones. The first scraping head may further have a concave inner surface.

In a subsequent step, the method may also include providing and affixing a bracket to an outer surface of first scraping head such that the bracket adjoins the apex. The bracket remains proximately juxtaposed adjacent to the outer surface. The method may further include the step of providing and removably coupling an elongated pole to the bracket such that the pole remains spaced posterior to the first scraping head to permit the user to freely engage the inner surface along the hard-to-reach target zones.

Next, the method may include the step of gripping the pole angling the first scraping head towards the hard-to-reach target zones by engaging the bottom curvilinear edge directly against the existing marine growth. Then, the existing marine growth is separated from the hard-to-reach target zone by reciprocating the first scraping head along upward and downwardly directions while firmly pressing the bottom curvilinear edge against the existing marine growth.

The top and bottom curvilinear edges may be spaced above and below the bracket for assisting a user to effectively separate the existing marine growth by upwardly and downwardly reciprocating the first scraping head against the hard-to-reach target zones respectively. Also, the first scraping head and the bracket may be formed from non-corrosive material.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Figure 1:
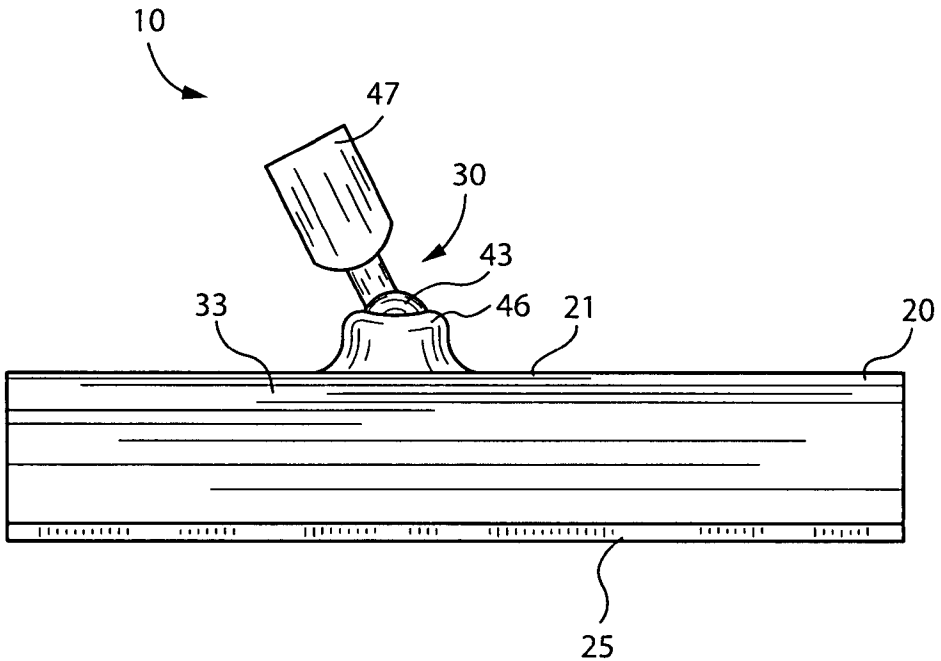
FIG. 1 is a side elevational view of a first scraping head and associated bracket, in accordance with one embodiment of the present invention.
Figure 2:
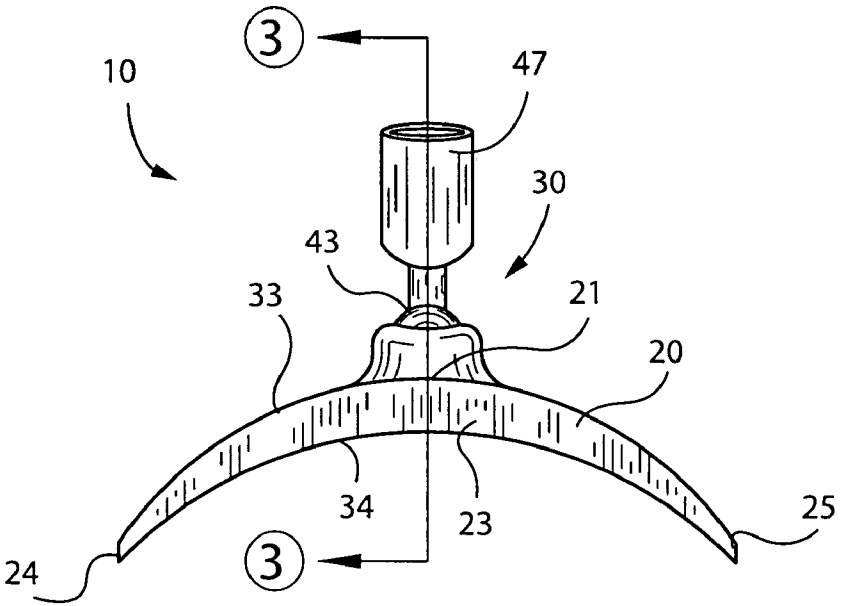
FIG. 2 is a front elevational view of the first scraping head and associated bracket shown in FIG. 1.
Figure 3:
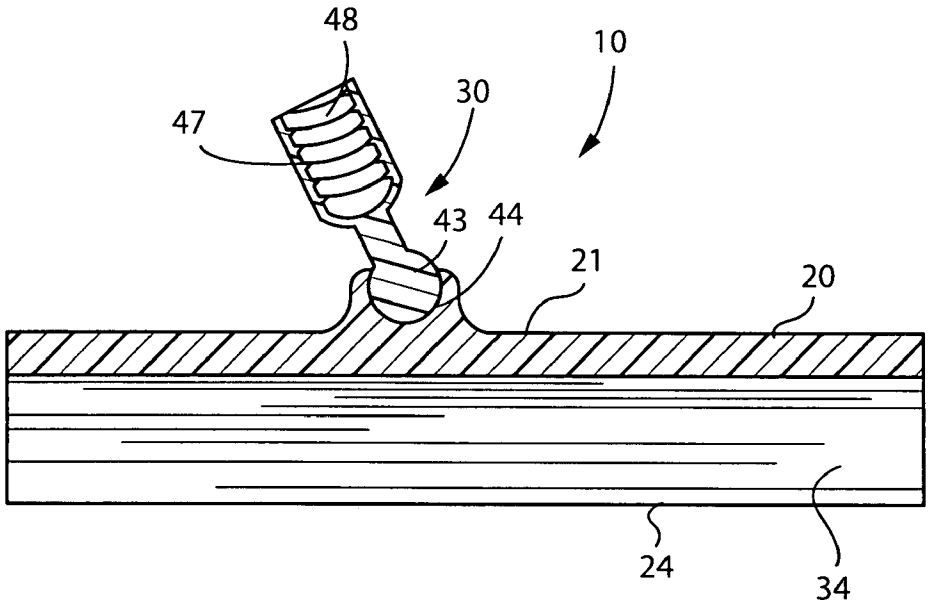
FIG. 3 is a cross-sectional view of the first scraping head and associated bracket taken along line 3-3 in FIG. 2.

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1-11 by reference numerals 10 and 100 and is intended to provide a scraping tool for removing existing marine growth from hard-to-reach target zones, such as dock pilings and boat hulls, for example. Exemplary marine growth may include barnacles, for example. It is noted that reference numerals 10 and 100 designated alternate embodiments of the present invention.

It should be understood that the scraping tool 10 and 100 may be used to remove, dislodge, separate and displace different types of objects from hard-to-reach target zones. For example, the present invention may be employed in the following embodiments and associated applications: small compact embodiment for allowing a diver to clean submerged debris from boat hulls and a running gear; large commercial embodiment for cleaning wide-load equipment and machines. Also, the present invention may be employed to clean smoke stacks and chimney exhaust flues, pontoons on pontoon boat hulls, and pipelines from oil rigs and underwater electrical lines, for example. The present invention may also be used to remove undesirable obstacles such as snow, dirt, debris and the like from driveways and walkways. Thus, the present invention is not intended to be limited to removing marine growth in aquatic environments, for example.

Referring initially to FIGS. 1-11, the present invention includes a scraping tool 10 and 100 preferably including a first scraping head 20 having a curvilinear shape and being provided with an apex 21 medially offset between oppositely seated lateral edges 24, 25 of the first scraping head 20. The first scraping head 20 may further have oppositely disposed top and bottom curvilinear edges 22, 23 for engaging and removing the marine growth from the hard-to-reach target zones. Such curvilinear edges 22, 23 preferably have rigid and suitably thin cross-sections for effectively severing the marine growth from the target zone. The first scraping head 20 may further have a concave inner surface 34 for conforming to an annular shape of a dock piling, for example.

Still referring to FIGS. 1-11, the present invention further includes a bracket 30 affixed to an outer surface 33 of the first scraping head 20 such that the bracket 30 adjoins the apex 21 and thereby remains proximately juxtaposed adjacent to the outer surface 33. Of course, it is understood the bracket 30 is suitably connected to the first scraping head 20, such as by welding, for allowing the user to easily maneuver the first scraping head 20 after a pole 40 (described hereinbelow) is attached to the bracket 30.

Notably, the top and bottom curvilinear edges 22, 23 are spaced above and below the bracket 30 for assisting a user to effectively engage the hard-to reach target zones without interference from the bracket 30. This permits the user to effectively separate the existing marine growth from the hard-to-reach target zones by upwardly and downwardly reciprocating the first scraping head 20 against the hard-to-reach target zones respectively. The first scraping head 20 and the bracket 30 are preferably formed from non-corrosive material to resist rust and decay during extended use in harsh environments, such as salt water, for example.

Again referring to FIGS. 1-11, the present invention may also an elongated pole 40 removably coupled to the bracket 30 and remaining spaced posterior to the first scraping head 20 such that the user is able to freely engage the inner surface 34 along the hard-to-reach target zones. By positioning the pole 40 directly into the bracket 30, the inner surface 34 as well as the top and bottom curvilinear edges 22, 23 are free to repeatedly engage and scrap the marine growth away from the hard-to-reach target zone while the user is safely positioned away from the first scraping head 20.

In one embodiment, as shown in FIGS. 1-5, the apex 21 of the first scraping head 20 preferably has a thickness that is greater than a thickness of the lateral edges 24, 25 respectively and thereby defines a center of mass at the apex 21 for assisting the user to effectively maneuver the first scraping head 20 along the hard-to-reach target zones. Such a feature is important because although the bracket 30 and pole 40 freely pivot with respect to the first scraping head 20, the user is able to maintain suitable control and accuracy when the center of mass is aligned with the longitudinal axis of the pole 40, for example.

Figure 4:
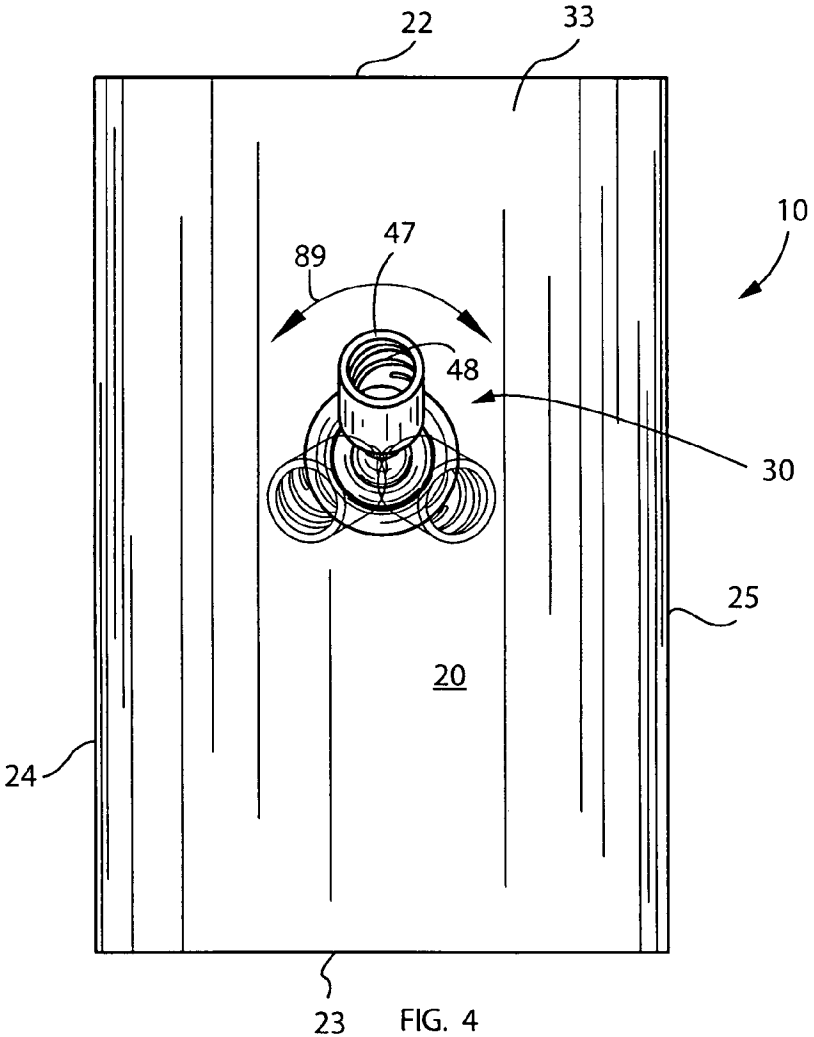
FIG. 4 is a top plan view of the first scraping head and associated bracket shown in FIG. 1.
Figure 5:
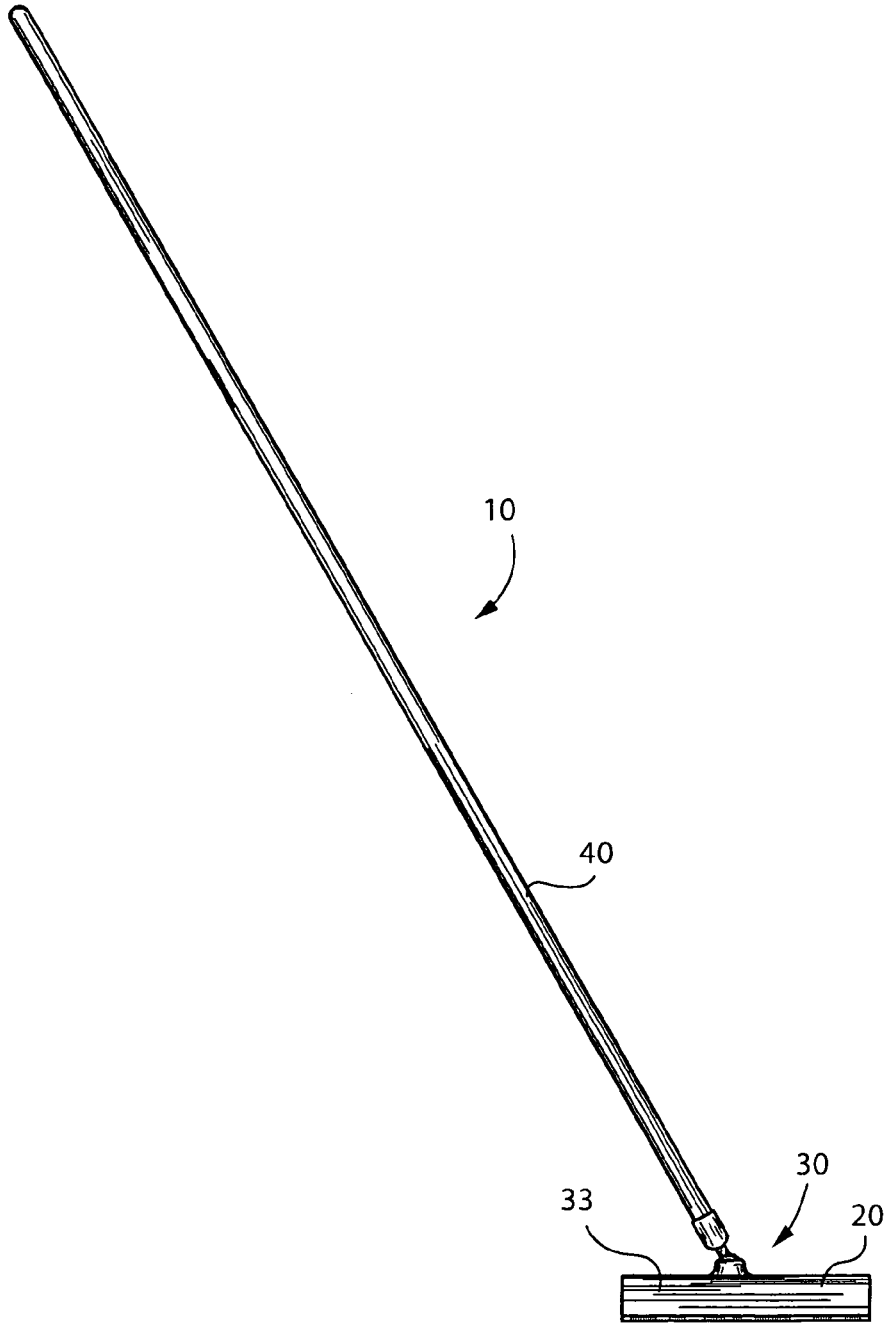
FIG. 5 is a side elevational view showing a pole attached to the first scraping head and associated bracket of FIG. 1.
Figure 6:
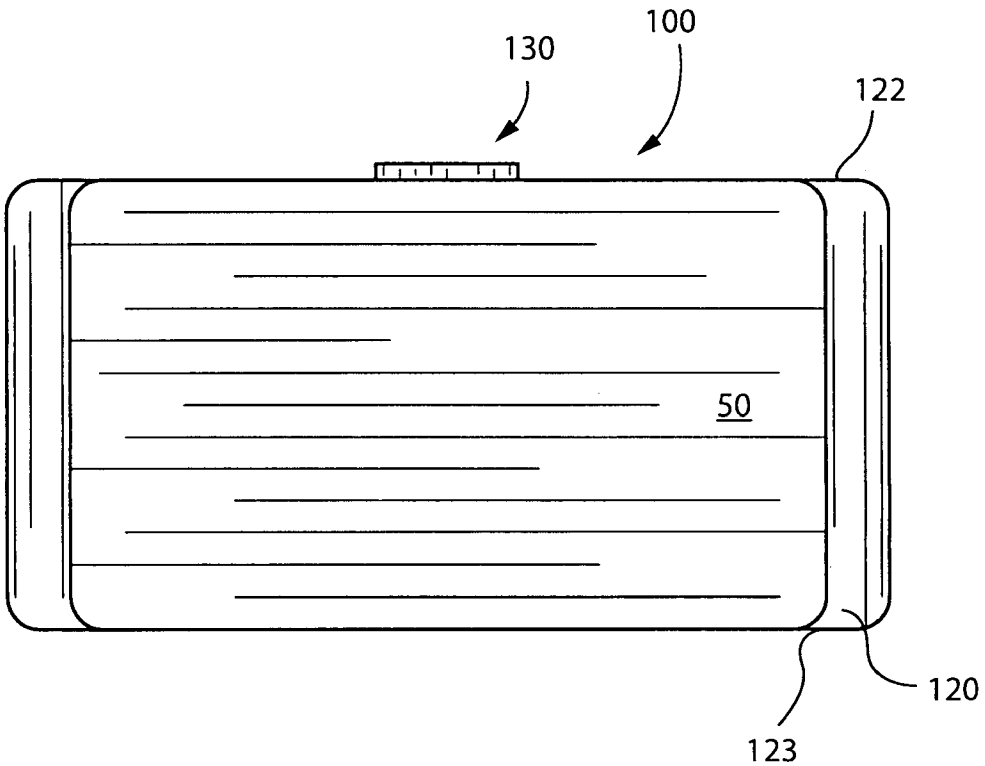
FIG. 6 is a bottom plan view show an alternate embodiment of the present invention, wherein first and second scraping heads are attached to a bracket intercalated therebetween.
Figure 7:
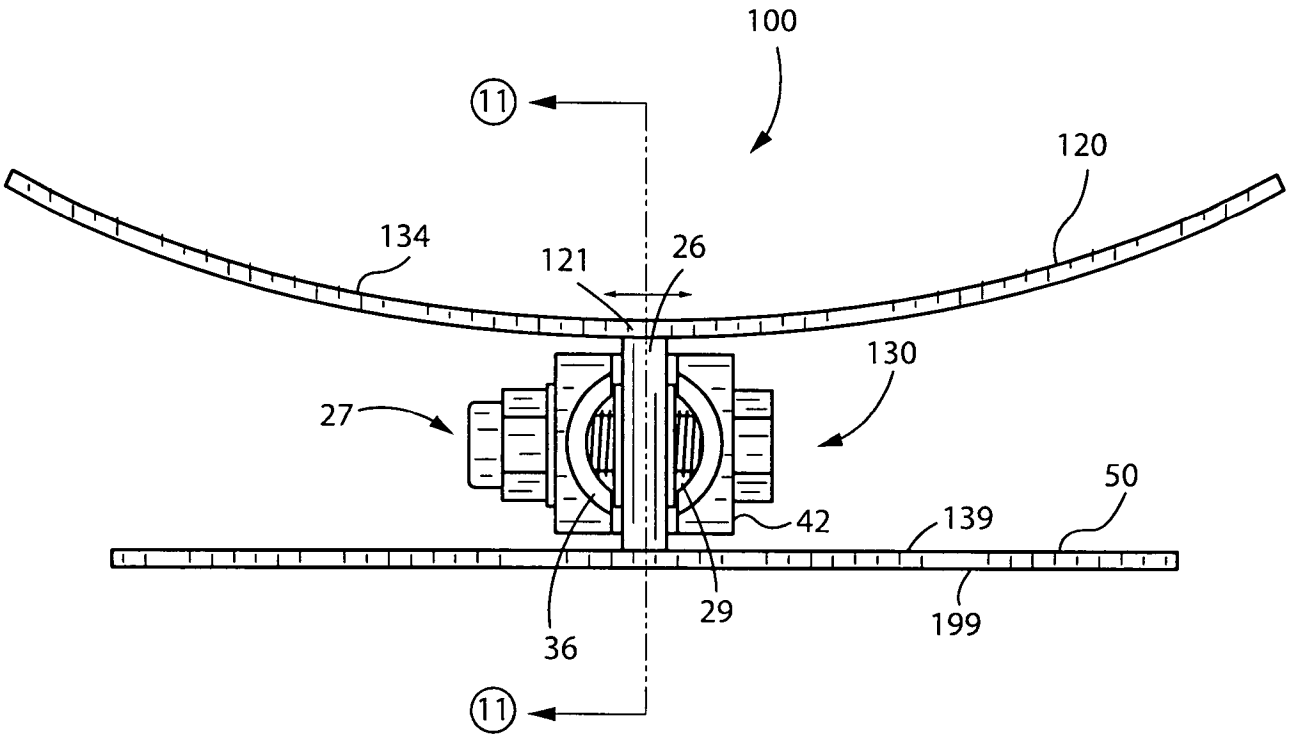
FIG. 7 is a cross-sectional view showing the second axial end of the bracket.
Figure 8:
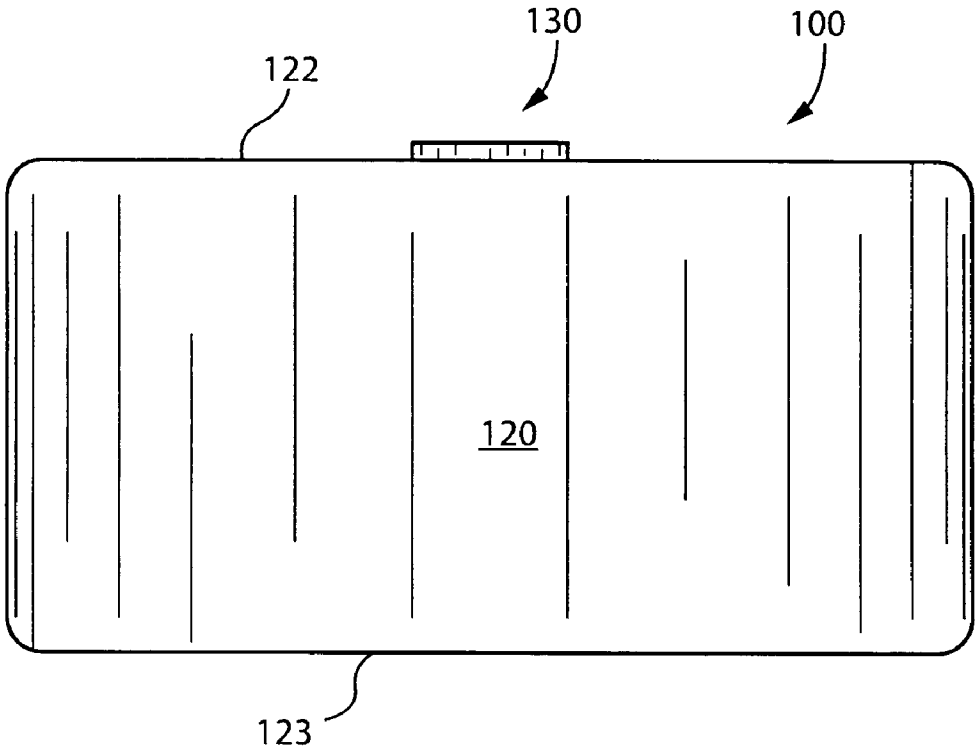
FIG. 8 is a top plan view showing the curvilinear first scraping head.
Figure 9:
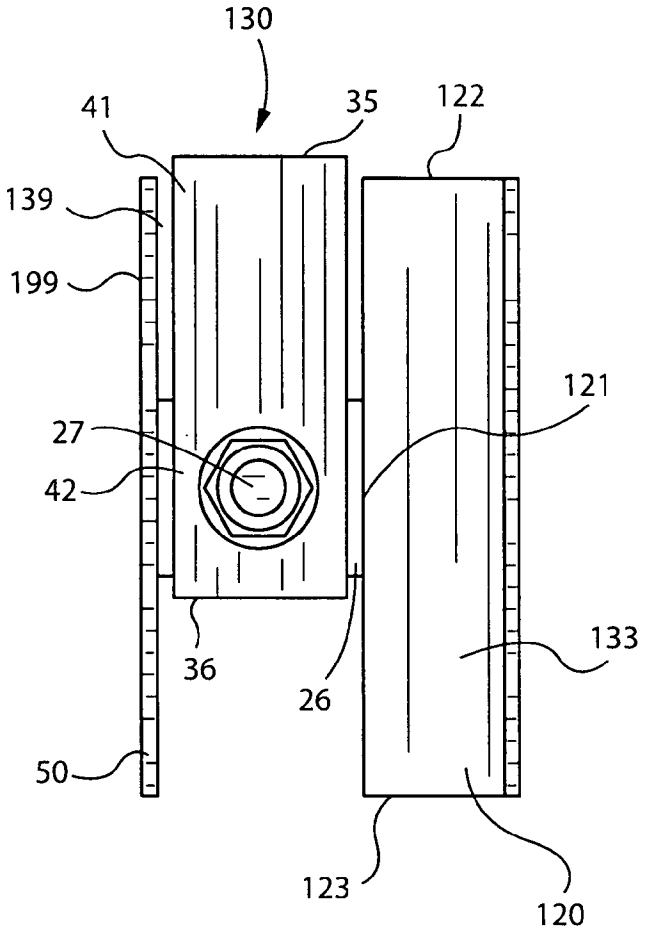
FIG. 9 is a cross-sectional view taken along line 9-9 showing the bracket intercalated between the first and second scraping heads.

In such an embodiment, the bracket 30 preferably includes a stationary anchor 46 statically affixed directly to the outer surface 33 of the first scraping head 20. Such a stationary anchor 46 has a socket 44 formed therein, which faces away from the outer surface 33 of the first scraping head 20. The bracket 30 may further include a mobile anchor 47 provided with a ball 43 formed at a distal end thereof. The ball 43 is rotatably seated within the socket 44 such that the mobile anchor 47 is freely articulated along a 360 degree circular path 89 defined adjacent to the outer surface 33, as best shown in FIG. 4. This feature permits the user to freely bias the first scraping head 20 at various angles during scraping procedures.

Still referring to FIGS. 1-5, the mobile anchor 47 may further have a threaded sleeve 48 formed at a proximal end thereof. Such a sleeve 48 preferably faces away from the first scraping head 20 and is securely mated with the pole 40 such that the first scraping head 20 and the stationary anchor 46 remain at a fixed position while the pole 40 and the mobile anchor 47 are contemporaneously articulated along the circular path.

In another embodiment 100, as shown in FIGS. 6-11, the present invention preferably includes a connector 26 directly and statically connected to the outer surface 133 of the first scraping head 120. Such a connector 26 is preferably aligned with the apex 121 of the first scraping head 120 to support the first scraping head 120 at its center of mass. In this manner, the user is able to accurately bias the first scraping head 120 between various positions without having to overcompensate for any weight offset from the pole 40, for example.

The connector 26 may orthogonally extend away from the apex 121 and may further terminate at a predetermined distance therefrom such that the connector 26 remains situated posterior of the inner surface 134 during use of the first scraping head 120. It is noted that the thickness of the connector 26 is preferably minimized to reduce the likelihood of weighing down the first scraping head 120 during reciprocating motions. Also, it is important for the connector 26 to terminate within an outer perimeter of the first scraping head 120 to permit continuous contact between the top and bottom curvilinear edges 122, 123 during upward and downward movement along the marine growth, for example.

Now referring to FIGS. 7 and 9-11, in particular, the bracket 130 in such an embodiment is preferably provided with orthogonally registered first and second bores 28, 29 formed therein. The first bore 28 may be axially aligned along a partial longitudinal length of the bracket 130 in such a manner that the connecter is spaced from the first bore 28. The first bore 28 may also have a threaded inner surface 184 and may be formed in a first half 41 of the bracket 130 such that the first bore 28 axially extends from a first axial end 35 of the bracket 130 and terminates substantially midway to an opposing second axial end 36 of the bracket 130. In this manner the connector 26 is able to penetrate through the bracket 130 without intersecting the first bore 28. This permits the first half 41 of the bracket 130 to maintain a fixed diameter for removably receiving the pole 40 at said first bore 28.

The second bore 29 is preferably formed at a second half 42 of the bracket 130 and may extend along a mutually exclusive path that is offset from the first bore 28, so that the pole 40 remains spaced away from the second bore 29 does not exert operating forces on the connector 26 during reciprocating motions. The second bore 29 preferably begins from approximately midway between the first and second axial ends 35, 36 of the bracket 130 and terminates at the second axial end 36 of the bracket 130 such that an opening is formed at the second axial end 36 for receiving the connector 26 therethrough. In this manner, the user is able to freely and selectively reconnect a variety of scraping heads to the bracket 130 while the pole 40 remains continuously affixed to the bracket 130, for example.

Still referring to FIGS. 7 and 9-11, the connector 26 may have a substantially rectangular shape and preferably passes through an entire width of the second bore 29 such that opposed edges of the connector 26 are situated exterior of the bracket 130. Thus, an empty buffer zone 91 is formed between the bracket 130 and the scraping heads to minimize any potential of undesirable forces acting against the outer surface 133 of the scraping heads 120, 50.

As perhaps best shown in FIGS. 7 and 9-11, the present invention 100 may further include a rigid fastening member 27 traversing through the connector 26 as well as the second bore 29 respectively. The fastening member 27 is preferably located at the second half 42 of the bracket 130 such that a diameter of the second half 42 of the bracket 130 is selectively reduced and expanded as the fastening member 27 is tightened and loosened respectively. In particular, the second bore 29 is in open communication with the second axial end 36 of the bracket 130. This permits the second half 42 of the bracket 130 to be resiliently compressed and expanded as the fastening member 27 is tightened and loosed. Such an expansion and compression may occur along a bi-directional rectilinear path, as perhaps best shown in FIG. 7 by the reference arrows. Such a fastening member 27 may include a conventional threaded bolt, washers and associated nut for permitting the user to quickly and effectively connect the fastening member 27 to the connector 26 and bracket 130, as needed.

In this manner, the fastening member 27 maintains the connector 26 statically affixed to the second half 42 of the bracket 130 and thereby prohibits the first scraping head 120 from becoming undesirably displaced away from the bracket 130 during reciprocating motions. Because the first scraping head 120 has a center of mass aligned with the connector 26, the weight of the fastening member 27 is further aligned with the apex 121 of the first scraping head 120 to reduce any likelihood of premature shifting between the fastening member 27 and bracket 130 during extended scraping procedures.

Referring now to FIGS. 6-11, the present invention 100 may further include a second scraping head 50 statically affixed directly to the connector 26 such that the first and second scraping heads 120, 50 maintain a fixed spatial distance 91 therebetween, respectively. Thus, the pole 40 is prevented from knocking against the first and second scraping heads 50, 120 during quick and abrupt jerking motions by the user.

Notably, the bracket 130 is intercalated between the first and second scraping heads 120, 50 and thereby permits the outer surfaces 133,139 of the first and second scraping heads 120, 50 to remain equidistantly offset from the pole 40 such that the user can interchangeably employ the first and second scraping heads 120, 50 by rotating the pole 40 approximately 180 degrees. For example, the second scraping head 50 may be situated anterior of the bracket 130 while the first scraping head 120 is situated posterior of the bracket 130 for enabling the user to quickly toggle between the first and second scraping head 120, 50, as needed, during scraping procedures.

As perhaps best shown in FIGS. 7 and 9-11, the second scraping head 50 may have a rectangular shape and may be provided with rectilinear inner and outer surface 199, 139 for engaging substantially planar target zones, such as boat hulls, for example. The second scraping head 50 may further have rigid top and bottom edges for effectively removing the existing marine growth, similar to the first scraping head 120. The cross-section of the first and second scraping heads 120, 50 may be suitably sized depending on the intended application.

Figure 10:
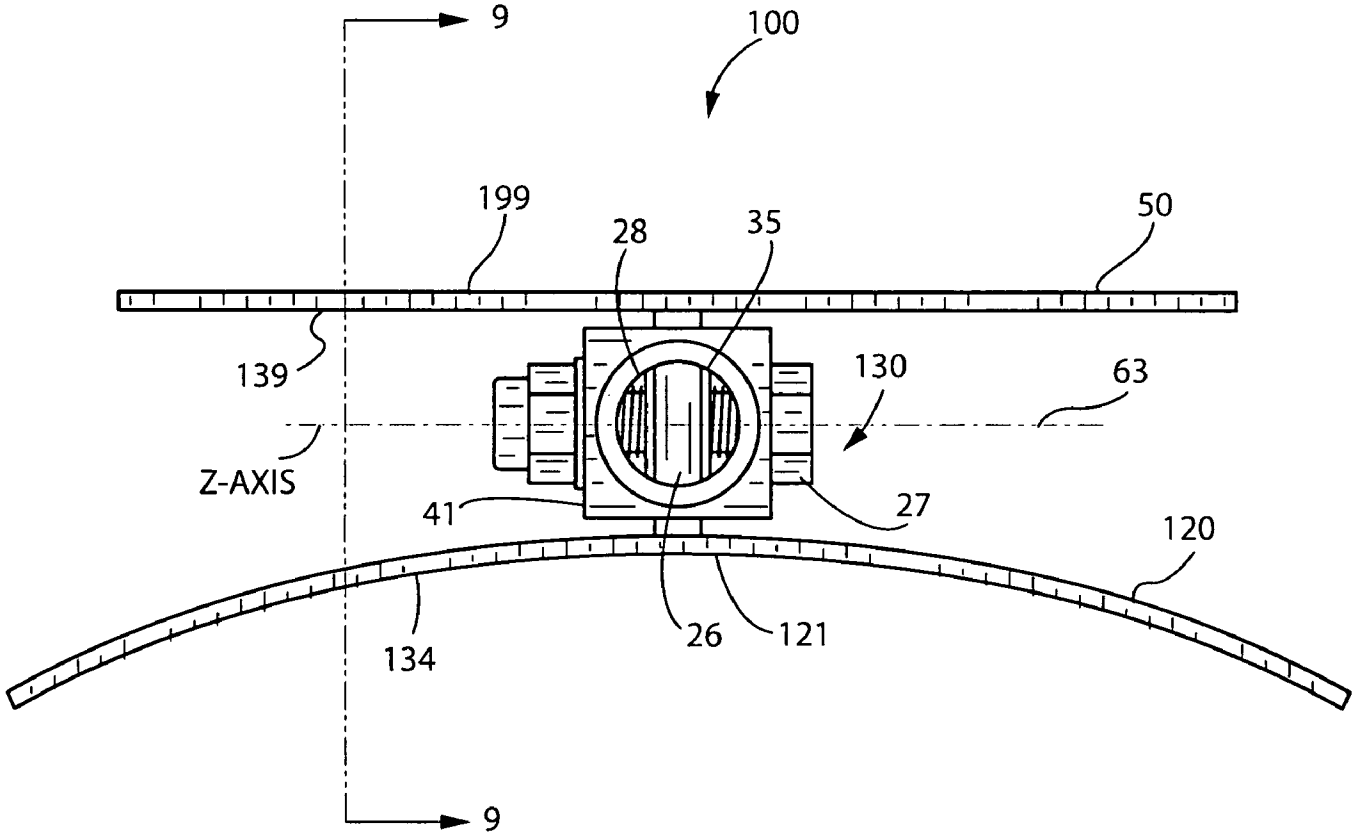
FIG. 10 is a cross-sectional view show the first axial end of the bracket for receiving the pole.
Figure 11:
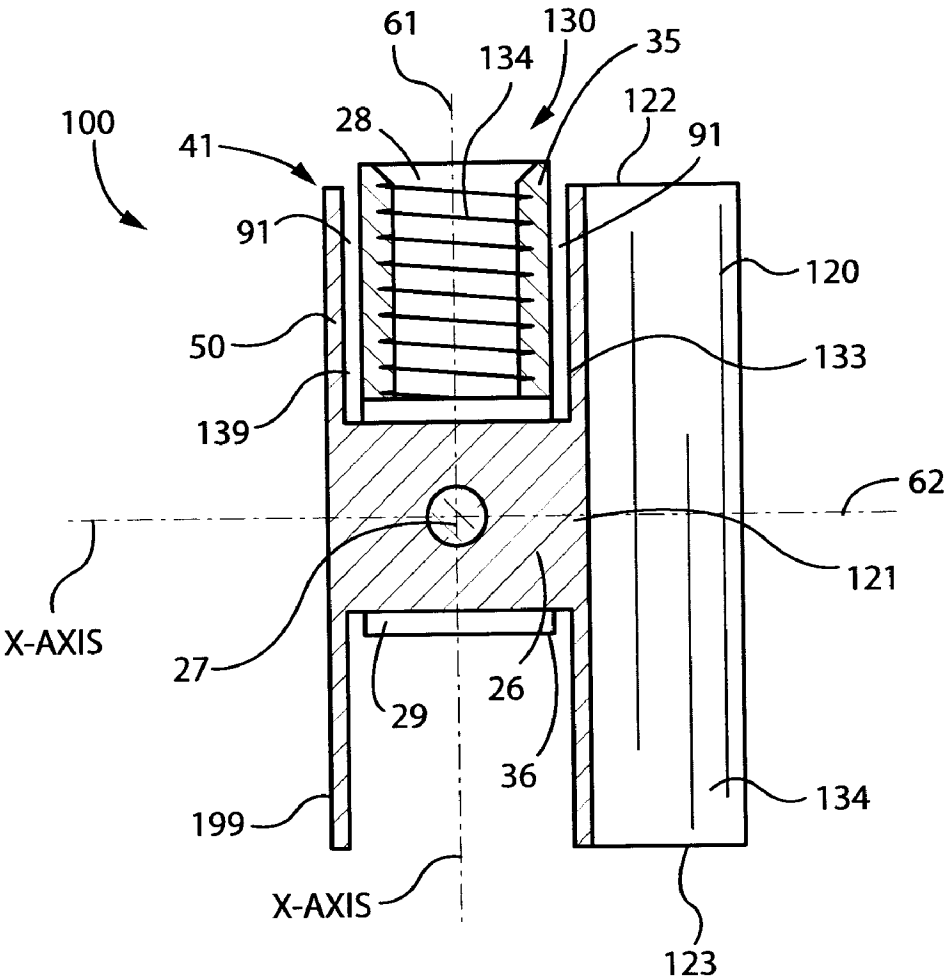
FIG. 11 is another cross-sectional view of the bracket showing the connector passed through the second half of the bracket.

In one embodiment, as perhaps best shown in FIGS. 10 and 11, the first and second bores 28, 29 may be respectively registered along first and second axes 61, 62 while the fastening member 27 may be registered along a third axis 63. Thus, the first 61, second 62 and third 63 axes may be respectively registered orthogonally to each other such that the first 61, second 62 and third 63 axes lay along an x-axis 61, a y-axis 62 and a z-axis 63 respectively. In this manner, operating forces acting along any one axis, may counter-balance and equalize operating forces that are oppositely acting along another axis, for example.

The present invention may further include a method for using a scraping tool to remove existing marine growth from hard-to-reach target zones. It is noted that the claimed method may be employed with all the embodiments 10 and 100. Such a method preferably includes the chronological steps of: providing a first scraping head having a curvilinear shape and being provided with an apex medially offset between oppositely seated lateral edges of the first scraping head. The first scraping head further has oppositely disposed top and bottom curvilinear edges for engaging and removing the existing marine growth from the hard-to-reach target zones. The first scraping head may further have a concave inner surface.

In a subsequent step, the method may also include providing and affixing a bracket to an outer surface of first scraping head such that the bracket adjoins the apex. The bracket remains proximately juxtaposed adjacent to the outer surface. The method may further include the step of providing and removably coupling an elongated pole to the bracket such that the pole remains spaced posterior to the first scraping head to permit the user to freely engage the inner surface along the hard-to-reach target zones.

Next, the method may include the step of gripping the pole angling the first scraping head towards the hard-to-reach target zones by engaging the bottom curvilinear edge directly against the existing marine growth. Then, the existing marine growth is separated from the hard-to-reach target zone by reciprocating the first scraping head along upward and downwardly directions while firmly pressing the bottom curvilinear edge against the existing marine growth. The first and second scraping head may adjusted to user-determined specifications by manipulating the first and second scraping heads to the appropriate angle, after which the present invention is used to scrape, prod, and remove any undesirable organic growth present on any surfaces.

For example, the scraping tool is preferably held at a non-perpendicular angle against the hard-to-reach target zone so that the scraping tool can effectively remove the marine growth without bouncing off the barnacles, for example. An exemplary angle may be approximately degrees, for example, but can vary according to location of the user and marine growth, as understood by one skilled in the art.

The top and bottom curvilinear edges may be spaced above and below the bracket for assisting a user to effectively separate the existing marine growth by upwardly and downwardly reciprocating the first scraping head against the hard-to-reach target zones respectively. Also, the first scraping head and the bracket may be formed from non-corrosive material.

While the invention has been described with respect to a certain specific embodiment, it will be appreciated that many modifications and changes may be made by those skilled in the art without departing from the spirit of the invention.

It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A scraping tool for removing existing marine growth from hard-to-reach target zones, said scraping tool comprising:

a first scraping head having a curvilinear shape and being provided with an apex medially offset between oppositely seated lateral edges of said first scraping head, said first scraping head further having oppositely disposed top and bottom curvilinear edges for engaging and removing the marine growth from the hard-to-reach target zones, said first scraping head further having a concave inner surface; and a bracket affixed to an outer surface of first scraping head and adjoining said apex such that said bracket remains proximately juxtaposed adjacent to said outer surface;

wherein said top and bottom curvilinear edges are spaced above and below said bracket for assisting a user to effectively separate the existing marine growth by upwardly and downwardly reciprocating said first scraping head against the hard-to-reach target zones respectively;

an elongated pole removably coupled to said bracket and remaining spaced posterior to said first scraping head such that the user is able to freely engage said inner surface along the hard-to-reach target zones;

a connector directly and statically connected to said outer surface of said first scraping head and being aligned with said apex respectively, said connector orthogonally extending away from said apex and terminating at a predetermined distance therefrom such that said connector remains situated posterior of said inner surface during use of said first scraping head;

wherein said bracket is provided with orthogonally registered first and second bores formed therein, said first bore being axially aligned along a longitudinal length of said bracket in such a manner that said connecter is spaced from said first bore.

2. The scraping tool of claim 1, wherein said first bore has a threaded inner surface and is formed in a first half of said bracket such that said first bore axially extends from a first axial end of said bracket and terminates substantially midway to an opposing second axial end of said bracket;

wherein said first half of said bracket has a fixed diameter for removably receiving said pole therein.

3. The scraping tool of claim 2, wherein said second bore is formed at a second half of said bracket and extends along a mutually exclusive path that is offset from said first bore, said second bore extending to said second axial end of said bracket such that an opening is formed at said second axial end for receiving said connector therethrough;

wherein said connector passes through an entire width of said second bore such that opposed edges of said connector are situated exterior of said bracket.

4. The scraping tool of claim 3, further comprising:

a rigid fastening member traversing through said connector as well as said second bore respectively, said fastening member being located at said second half of said bracket such that a diameter of said second half of said bracket is selectively reduced and expanded as said fastening member is tightened and loosened respectively;

wherein said fastening member maintains said connector statically affixed to said second half of said bracket and thereby prohibits said first scraping head from becoming undesirably displaced away from said bracket during reciprocating motions.

5. The scraping tool of claim 4, further comprising: a second scraping head statically affixed directly to said connector such that said first and second scraping heads maintain a fixed spatial distance therebetween, said second scraping head being situated anterior of said bracket while said first scraping head is situated posterior of said bracket, said second scraping head having a rectangular shape and being provided with rectilinear inner and outer surfaces, said second scraping head further having rigid top and bottom edges for effectively removing the existing marine growth;

wherein said bracket is intercalated between said first and second scraping heads and thereby permits said outer surfaces of said first and second scraping head to remain equidistantly offset from said pole such that the user can interchangeably employ said first and second scraping heads by rotating said pole 180 degrees.

6. The scraping tool of claim 5, wherein said first and second bores are respectively registered along first and second axes while said fastening member is registered along a third axis;

wherein said first, second and third axes are respectively registered orthogonally to each other such that said first, second and third axes lay along an x-axis, a y-axis and a z-axis respectively.

7. A scraping tool for removing existing marine growth from hard-to-reach target zones, said scraping tool comprising:

a first scraping head having a curvilinear shape and being provided with an apex medially offset between oppositely seated lateral edges of said first scraping head, said first scraping head further having oppositely disposed top and bottom curvilinear edges for engaging and removing the marine growth from the hard-to-reach target zones, said first scraping head further having a concave inner surface; and a bracket affixed to an outer surface of first scraping head and adjoining said apex such that said bracket remains proximately juxtaposed adjacent to said outer surface;

wherein said top and bottom curvilinear edges are spaced above and below said bracket for assisting a user to effectively separate the existing marine growth by upwardly and downwardly reciprocating said first scraping head against the hard-to-reach target zones respectively;

wherein said first scraping head and said bracket are formed from non-corrosive material;

an elongated pole removably coupled to said bracket and remaining spaced posterior to said first scraping head such that the user is able to freely engage said inner surface along the hard-to-reach target zones;

a connector directly and statically connected to said outer surface of said first scraping head and being aligned with said apex respectively, said connector orthogonally extending away from said apex and terminating at a predetermined distance therefrom such that said connector remains situated posterior of said inner surface during use of said first scraping head;

wherein said bracket is provided with orthogonally registered first and second bores formed therein, said first bore being axially aligned along a longitudinal length of said bracket in such a manner that said connecter is spaced from said first bore.

8. The scraping tool of claim 7, wherein said first bore has a threaded inner surface and is formed in a first half of said bracket such that said first bore axially extends from a first axial end of said bracket and terminates substantially midway to an opposing second axial end of said bracket;

wherein said first half of said bracket has a fixed diameter for removably receiving said pole therein.

9. The scraping tool of claim 8, wherein said second bore is formed at a second half of said bracket and extends along a mutually exclusive path that is offset from said first bore, said second bore extending to said second axial end of said bracket such that an opening is formed at said second axial end for receiving said connector therethrough;

wherein said connector passes through an entire width of said second bore such that opposed edges of said connector are situated exterior of said bracket.

10. The scraping tool of claim 9, further comprising:

a rigid fastening member traversing through said connector as well as said second bore respectively, said fastening member being located at said second half of said bracket such that a diameter of said second half of said bracket is selectively reduced and expanded as said fastening member is tightened and loosened respectively;

wherein said fastening member maintains said connector statically affixed to said second half of said bracket and thereby prohibits said first scraping head from becoming undesirably displaced away from said bracket during reciprocating motions.

11. The scraping tool of claim 10, further comprising: a second scraping head statically affixed directly to said connector such that said first and second scraping heads maintain a fixed spatial distance therebetween, said second scraping head being situated anterior of said bracket while said first scraping head is situated posterior of said bracket, said second scraping head having a rectangular shape and being provided with rectilinear inner and outer surfaces, said second scraping head further having rigid top and bottom edges for effectively removing the existing marine growth;

wherein said bracket is intercalated between said first and second scraping heads and thereby permits said outer surfaces of said first and second scraping head to remain equidistantly offset from said pole such that the user can interchangeably employ said first and second scraping heads by rotating said pole 180 degrees.

12. The scraping tool of claim 11, wherein said first and second bores are respectively registered along first and second axes while said fastening member is registered along a third axis;

wherein said first, second and third axes are respectively registered orthogonally to each other such that said first, second and third axes lay along an x-axis, a y-axis and a z-axis respectively.

* * * * *